US005363550A

United States Patent [19]

Aitken et al.

[11] Patent Number: 5,363,550

[45] Date of Patent: Nov. 15, 1994

[54] METHOD OF FABRICATING A MICRO-COAXIAL WIRING STRUCTURE

[75] Inventors: John M. Aitken, Mahopac, N.Y.; Shahzad Akbar, Austin, Tex.; Billy L. Crowder, Putnam Valley, N.Y.; Asif Iqbal, Danbury, Conn.; Perwaiz Nihal, Hopewell Junction, N.Y.

[73] Assignee: International Business Machines Corporation, Armonk, N.Y.

[21] Appl. No.: 996,210

[22] Filed: Dec. 23, 1992

[51] Int. Cl.[5] ..... H01B 13/20

[52] U.S. Cl. ..... 29/828; 29/846; 29/852; 427/96

[58] Field of Search ..... 427/96, 97; 29/828, 29/846, 852; 428/901

[56] References Cited

U.S. PATENT DOCUMENTS

| | | | |
|---|---|---|---|
| 3,370,184 | 2/1968 | Zuleeg . | |
| 3,391,454 | 7/1968 | Reimann et al. . | |
| 3,391,457 | 7/1968 | Reimann . | |
| 3,499,219 | 3/1970 | Griff et al. . | |
| 3,613,230 | 10/1971 | Griff . | |
| 3,649,274 | 3/1972 | Older et al. | 96/36.2 |
| 3,837,074 | 9/1974 | Griff . | |
| 3,922,479 | 11/1975 | Older et al. . | |
| 4,624,864 | 11/1986 | Hartmann | 427/96 X |
| 4,673,904 | 6/1987 | Landis | 333/238 |
| 4,776,087 | 10/1988 | Cronin et al. | 29/828 |
| 4,845,311 | 7/1989 | Schreiber et al. | 174/36 |
| 5,003,273 | 3/1991 | Oppenberg | 333/1 |

FOREIGN PATENT DOCUMENTS

| | | | |
|---|---|---|---|
| 4-267586 | 9/1992 | Japan | 427/96 |

*Primary Examiner*—Carl J. Arbes
*Attorney, Agent, or Firm*—Michael J. Balconi-Lamica

[57] ABSTRACT

A method of fabricating a micro-coaxial wiring structure comprises forming a first insulation layer and patterning a trench therein. A first conductive layer is formed on the first insulation layer and having a shape conforming to the insulation layer and lining the trench. A second insulation layer is formed on the first conductive layer within the trench and having a shape conforming to the first conductive layer lining the trench. A conductive signal line having a predetermined aspect ratio for providing a desired value of resistance per unit length is formed on the second insulation layer within the trench. A third insulation layer is then formed. Lastly, a conductive shielding line is formed upon the third insulation layer, the conductive shielding line being aligned with the conductive signal line.

7 Claims, 3 Drawing Sheets

METHOD OF FABRICATING A MICRO-COAXIAL WIRING STRUCTURE

BACKGROUND OF THE INVENTION

1. Field of the Invention

This invention relates to a micro-coaxial wiring structure fabricated in VLSI dimensions, as well as to a manufacturing method for making such a structure.

2. Discussion of the Related Art

Improvements in the VLSI technology are resulting in smaller interconnect and spacing, larger chip sizes, increased circuit density, and faster devices. The average and the maximum on-chip interconnect lengths are becoming larger because of the increase in chip size as well as device density. Owing to the larger interconnect length and faster devices, i.e., faster signal rise times, the wires connecting the devices on the chip act like transmission lines. In other words, the interconnect wire can, no longer, be considered just a lumped capacitive load, rather, it becomes a linear network of resistance (R), inductance (L), and capacitance (C) elements. Thus, the interconnect needs to be appropriately modeled to optimize the high frequency pulse propagation without severe signal degradation and losses. Two of the transmission line parameters, i.e., the characteristic impedance (ZO), and the attenuation constant ($\alpha$), serve as metrics for the high frequency pulse propagation.

The increased wiring density reduces the spacing between adjacent signal lines resulting in increased coupled noise. The coupled noise is an unwanted electromagnetic interference in the signal pulse degrading the signal fidelity. The backward coupling coefficient (Kb) characterizes the near-end noise (NEN) between two adjacent signal lines.

The faster rise times and broader signal bandwidth are making it imperative that interconnects be modeled as transmission lines and that the coupled noise be held to a minimum. Thus, there is a need to design the on-chip interconnects having a controlled electromagnetic environment for the propagation of high speed signals.

In U.S. Pat. No. 4,776,087, issued Oct. 11, 1988 to Cronin et. al., a VLSI coaxial wiring structure is disclosed which fully shields the signal conductor for eliminating the coupling effects from adjacent signal conductors. The fully shielded structure of Cronin et. al., however, is not an optimum structure from the perspective of high speed pulse propagation. To minimize noise in the signal lines, the characteristic impedance of the signal lines should be as close to 50 ohm as possible. As the impedance is dependent upon the geometry of the structure, the structure taught by Cronin et. al. provides for a low characteristic impedance because of increased capacitive coupling due to the complete shielding. The complete shielding results in a higher overall noise, since only a ground connection is provided for. This further results in increased pulse attenuation for the rising transition of a propagated signal and, still further, results in increasing the simultaneously switching noise due to the higher power supply inductance.

There is thus a need for a micro-coaxial wiring structure which provides signal lines having a characteristic impedance as close to 50 ohm as possible and which improves high speed pulse propagation while substantially reducing cross-talk between adjacent signal lines.

SUMMARY OF THE INVENTION

It is an object of the invention to overcome the problems in the art discussed above.

It is an object of the invention to provide a microcoaxial wiring structure and a method of making the same which substantially reduces cross-talk between adjacent signal lines.

Still another object of the invention is to provide a microcoaxial wiring structure and a method of making the same wherein a desired value of resistance per unit length of a conductive signal line is obtained.

According to the present invention, a method of fabricating a micro-coaxial wiring structure comprises the steps of:

a) forming a first insulator layer;

b) patterning a first trench of first dimensions in the first insulator layer;

c) forming a first conductive layer on the first insulator layer, the first conductive layer having a shape conforming to the first insulator layer and lining the first trench to form a second trench of second dimensions within the first trench;

d) forming a second insulator layer on the first conductive layer, the second insulator layer having a shape conforming to the first conductive layer and lining the second trench to form a third trench of third dimensions within the second trench;

e) planarizing the second insulator layer down to the first conductive layer, thereby planarizing the third trench, the planarized third trench being of predetermined dimensions;

f) forming a conductive signal line within the planarized third trench, the conductive signal line having a predetermined aspect ratio of width to height corresponding to the dimensions of the planarized third trench for providing a desired value of impedance per unit length and further being electrically shielded by the first conformal conductive layer;

g) forming a third insulation layer upon the first conductive layer, the second insulation layer, and the conductive signal line; and h) forming a conductive shielding line upon the third insulation layer, the conductive shielding line being in alignment with the first trench and further shielding the conductive signal line.

In addition, a micro-coaxial wiring structure according to the present invention comprises a substrate having an insulation layer thereon. A trench is patterned in the insulation layer of said substrate. A first conductive layer is formed on the insulation layer, the first conductive layer having a shape conforming to the insulation layer and lining the trench. A second insulation layer is formed on the first conductive layer within the trench, the second insulation layer having a shape conforming to the first conductive layer lining the trench and further having a top surface coplanar with a top surface of the first conductive layer. A conductive signal line having a predetermined aspect ratio for providing a desired value of impedance per unit length is formed on the second insulation layer within the trench. A third insulation layer is formed upon the the first conductive layer, the second insulation layer, and the conductive signal line. Lastly, a conductive shielding line is formed upon the third insulation layer, the conductive shielding line being aligned with the conductive signal line.

BRIEF DESCRIPTION OF THE DRAWINGS

The foregoing and other teachings of the present invention will become more apparent upon a detailed description of the best mode for carrying out the invention as rendered below. In the description to follow, reference will be made to the accompanying drawings, in which.

DETAILED DESCRIPTION OF THE PREFERRED EMBODIMENTS

Figure 1:
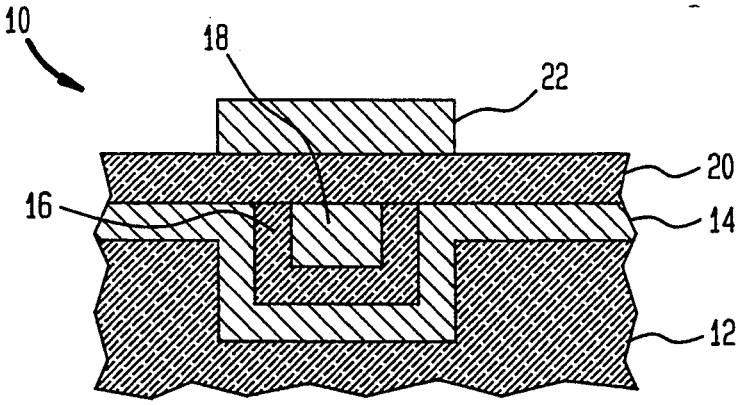
FIG. 1 shows a cross-sectional view of a micro-coaxial wiring structure according to the present invention.

The micro-coaxial wiring structure of the present invention is best understood by referring to FIGS. 1–4 of the drawings, like numerals being used for like and corresponding parts of the various drawings. Referring now to FIG. 1, a micro-coaxial wiring structure 10 comprises a first dielectric layer 12 having a first shallow trench of desired dimensions formed therein. A first conformal conductive layer or ground wiring plane 14 is formed upon the first dielectric layer 12, the ground plane 14 having a second shallow trench of corresponding dimensions formed therein. A second dielectric layer or inter-wiring dielectric 16 is formed within the second trench of ground plane 14, the inter-wiring dielectric 16 having a third trench of predetermined dimensions formed therein. A conductive signal line 18 is formed within the third trench of inter-wiring dielectric 16, whereby the ground plane 14 provides electrical shielding for the conductive signal line 18. The uppermost surfaces of ground plane 14, inter-wiring dielectric 16, and conductive signal line 18 are co-planar. A third dielectric layer 20 of a desired thickness is formed upon conductive layer 14, dielectric layer 16, and signal line 18. Lastly, a conductive shielding line 22 is formed upon the third dielectric layer 20, the conductive shielding line 22 being in alignment with the first trench and further shielding the conductive signal line 18.

Figure 2:
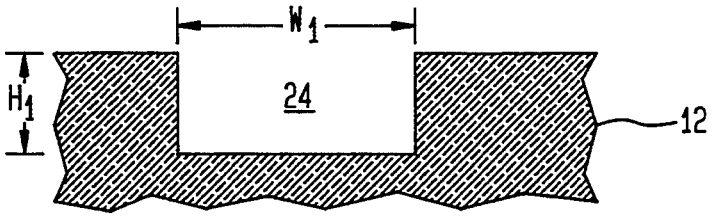
FIGS. 2–4 show cross-sectional views of an dielectric layer undergoing the process for forming the micro-coaxial wiring structure of FIG. 1.

Referring now to FIG. 2, formation of the micro-coaxial wiring structure 10 of the present invention begins with the formation of dielectric layer 16, the dielectric layer comprising silicon dioxide, polyimide or any other suitable organic or inorganic dielectric material. Such a dielectric layer 16 may comprise a layer formed upon a silicon substrate (not shown), the silicon substrate having transistor devices and/or other local interconnect wiring formed thereon. Dielectric layer 16 may be formed, by chemical vapor deposition (CVD), spin-on techniques, or other well known techniques in the art, to a desired thickness depending upon the requirements of a particular micro-coaxial wiring application. For example, in semiconductor device applications, the desired thickness can be a thickness in the range of 1000–5000 Å. More particularly, the desired thickness of dielectric layer 12 is at least equal to the sum of the desired thicknesses of ground wiring plane 14, inter-wiring dielectric 16, and a desired amount of dielectric material layer 12 to remain in a region below the lowermost portion of ground wiring plane 14 and above the underlying substrate (not shown).

A first shallow trench 24 of prescribed dimensions is formed in dielectric layer 12 using photolithography and reactive ion etching (RIE). Other well known techniques for forming shallow trench 24 may likewise be used. The depth ($h_1$) of trench 24 is required to be at least equal to the sum of the desired thicknesses of the ground wiring plane 14 and the inter-wiring dielectric 16. The width ($w_1$) of first trench 24 preferably comprises the cumulative widths of the desired width (to be subsequently discussed) of conductive signal line 18, two times the width of ground wiring plane 14, and two times the width of inter-wiring dielectric 16.

To form ground wiring plane 14, a conformal layer of a metal, such as, Al, Cu, W, Au or their alloys, is electroplated or deposited by other known techniques to a desired thickness, the desired thickness being in proportion to the desired thickness of the conductive signal line 18. Conformal ground wiring plane 14 provides a second trench 26 having height ($h_2$) and width ($w_2$) dimensions within first trench 24. Ground wiring plane 14 may likewise be deposited by CVD. (See FIG. 3). In addition to providing shielding for the subsequently formed conductive signal line 18, ground wiring plane 14 advantageously provides a thermal conductive path to assist in dissipating heat away from underlying devices. The ground wiring plane 14 further assists in minimizing ground bounce in CMOS circuits.

An optional polish stop layer (not shown) may be formed upon the ground plane 14 where necessary to provide an etch stop during subsequent chemical mechanical polishing and etching processes. The polish stop layer can comprise a thin layer of a hard refractory material, such as, boron nitride or titanium nitride.

Inter-wiring dielectric 16 is formed upon ground wiring plane 14 by well known plasma enhanced chemical vapor deposition (PECVD) or sputter deposition processes. Inter-wiring dielectric 16 is a conformal layer, thereby lining the second trench 26 and forming a third trench 28 having height ($h_3$) and width ($w_3$) dimensions. The thickness of inter-wiring dielectric 16 is established to be that thickness which is sufficient for obtaining a desired aspect ratio in the horizontal and vertical dimensions, and dependent upon the conformality of the deposition technique used in the formation thereof. Inter-wiring dielectric 16 can comprise silicon dioxide, for example.

Figure 3:
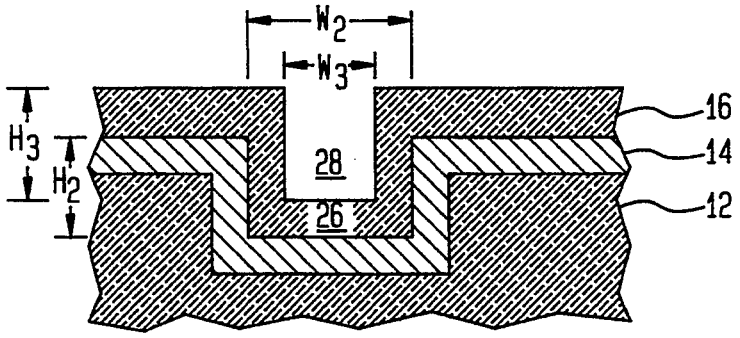
Figure 4:
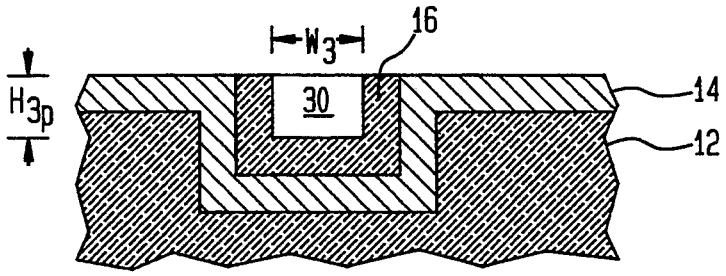

The structure as shown in FIG. 3 is then planarized by chemical-mechanical polishing, such that the uppermost surface of the inter-wiring dielectric 16 is coplanar with the uppermost surface of ground wiring plane 14 (FIG. 4). A planarized third trench or small planar trench 30 is thereby formed having height ($h_{3P}$) and width ($w_3$) dimensions. Chemical-mechanical polishing is well known in the art and therefor not discussed herein. In the instance where a polish stop is required (as previously discussed), the inter-wiring dielectric 16 is planarized down to the polish stop material.

The small planar trench 30 is thereafter filled with a conformal conductive metal by electroplating, for example, and then planarized by chemical-mechanical polishing, the conductive metal forming conductive signal line 18. Conductive signal line 18 thereby comprises a conductive signal line having a desire aspect ratio of width ($w_3$) to height ($h_3p$) to obtain a desired impedance per unit length. By process steps presented, conductive signal line 18 having the desired electrical characteristics (to be further discussed below) is easily fabricated. In the instance where inter-wiring dielectric 16 comprises silicon dioxide, no etch stop layer is necessary as a result of the high selectivity between metal and silicon dioxide. However, should inter-wiring dielectric 16 comprise polyimide, an etch/polish stop layer may be necessary.

The third dielectric layer or insulation layer 20 is formed upon the planarized surfaces of the ground plane conductor 14, inter-wiring dielectric 16, and conductive signal line 18 (FIG. 1). The insulation layer 20 is of a desired thickness.

The second conductive shielding line or power wiring 22 is formed above the conductive signal line 18 by well known metal deposition and patterning techniques, such as, sputter deposition and photolithography. The conductive shielding line 22 is patterned such that it is aligned on top of the signal wire to provide a desired shielding effect. Conductive shielding line 22 is preferably connected to a power source which is different from ground. An advantage of maintaining conductive shielding line 22 at a different voltage potential than ground plane 14 is to minimize circuit noise associated with devices turning on/off, i.e., simultaneously switching noise. The resultant microcoaxial wiring structure is shown in FIG. 1.

Figure 5:
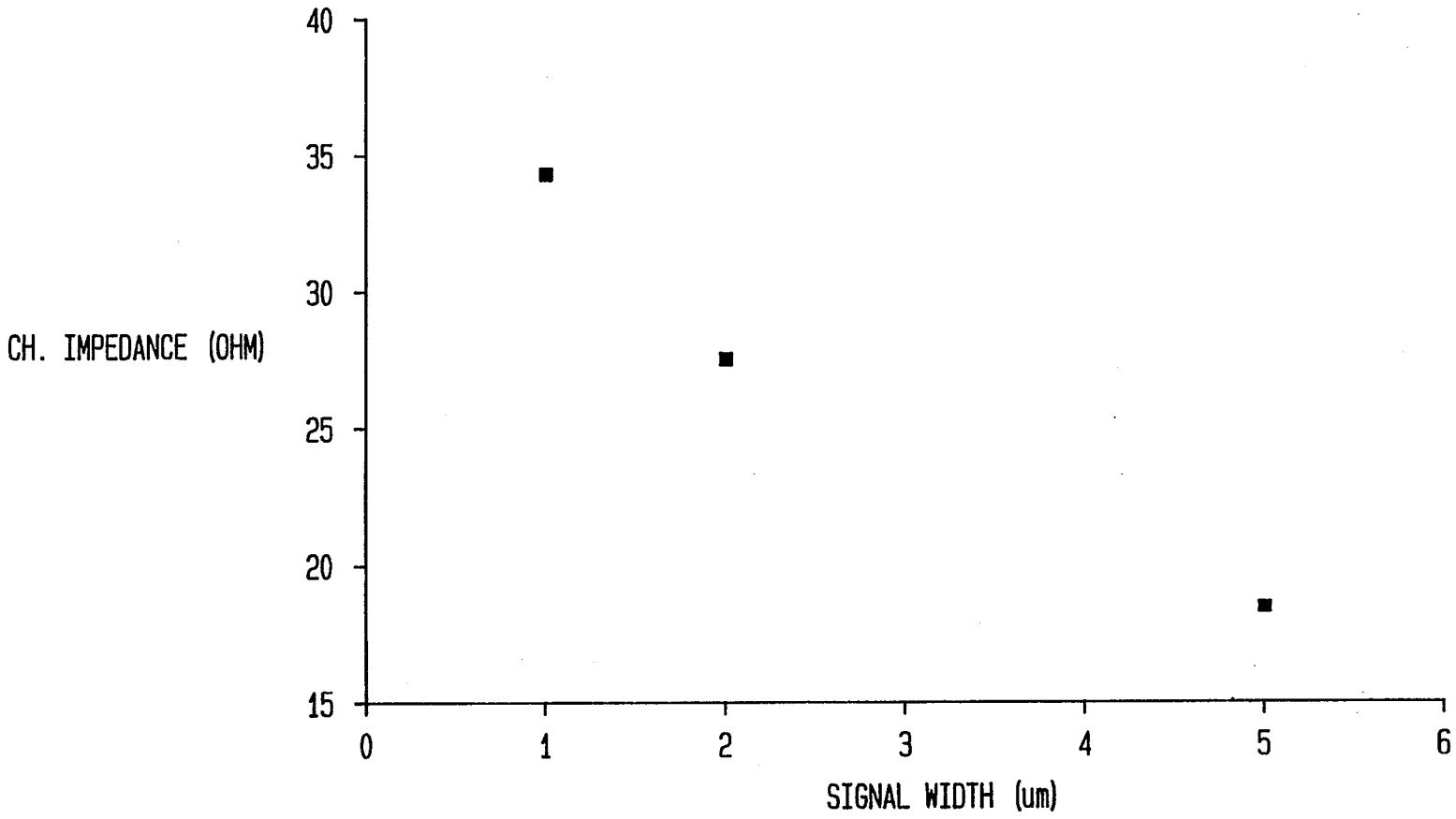
FIG. 5 shows a graph of characteristic impedance versus signal conductor width.

As indicated above, conductive signal line 18 comprises a conductive signal line having a desired aspect ratio of width ($w_3$) to height ($h_3p$) to obtain a desired resistance per unit length and/or characteristic impedance Z0. For example, referring now to FIG. 5, the characteristic impedance Z0 of the signal line 18 is related to the width ($w_3$). As can be seen from the FIG. 5, a characteristic impedance of greater than 25 can be obtained with a signal line width of less than 2 microns. The dimensions of the trenches are chosen so as to obtain a planarized third trench for providing the desired cross-sectional area or dimensions of conductive signal line 18.

Electrical performance of the micro-coaxial wiring structure 10 is further characterized by the backward coupling coefficient, Kb, and the attenuation constant, $\alpha$. The electrical configuration of the microcoaxial wiring structure 10 of the present invention can be modeled using an electrostatic modeling program as described by Albert Ruehli et. al. in *IEEE Journal of Solid State Circuits*, Vol. SC-10, No. 6 (1975) or by commercially available modeling software such as the Maxwell by Ansoft Corporation, Pittsburg, Pa. Using electrostatic modeling, the dimensions of conductive signal line 18 and the required spacing between ground-wiring plane 16 and conductive shielding line 22, can be determined for providing the desired electrical characteristics and electrical performance. The conductive signal line 18 preferably comprises a signal wire, the conductive ground plane 14 is attached to ground, and the conductive shielding line 22 can either be connected to power or ground. For the purpose of computer simulation, the ground plane 14 and the conductive shielding line 22 were treated as ground planes. The width and height of the wires were kept nominally at one micron, with the dielectric spacing being one micron also, i.e. the thickness of dielectric layers 16 and 20 was set at one micron. The conductive signal line 18 was chosen to be copper with an electrical resistivity of 2 micro-ohm cm whereas the dielectric layers 16 and 20 were selected to be silicon dioxide, having a dielectric constant of 4. The electrostatic modeling yielded the following electrical characteristics:

| | |
|---|---|
| Capacitance: | C11 = 2.23 pF/cm |
| | C12 = 0.49 fF/cm |
| Inductance: | L11 = 2.05 nH/cm |
| | L12 = 0.45 pH/cm |
| Characteristic Impedance: | Z0 = 30.3 ohm |
| Coupled Noise | Kc = C12/C11 = 0.022% |
| | Kl = L12/L11 = 0.022% |
| | Kb = (Kc + Kl)/4 = 0.011% |
| Propagation Delay T0 = 67.5 ps/cm | |

The inductive and capacitive coupling noise between adjacent signal lines is virtually eliminated. The relatively high characteristic impedance allows reasonably long transmission line length without loss of signal fidelity. If a longer transmission length is desired, the dimensions of the conductive signal line 18 can be increased.

The electrical design can be altered to achieve even higher characteristic impedance for a slightly higher coupling noise by reducing or eliminating the top conductor or conductive shielding line 22. Similarly, the number of inter-level ground planes can be minimized and it might also be possible to combine x-direction and y-direction wiring in one plane using coaxial wiring. The electrical characteristics of the micro-coaxial wiring structure of the present invention is favorable compared to presently known wiring methodologies.

In another example, for a 1 micrometer cross-section conductive signal line 18 and a 1 micrometer distance between the signal line 18 and the power 22 and ground 14 planes, the electrical modeling was found to produce characteristic impedance Z0 to be 34 ohm, Kb to be 0.9% of the signal swing, and $\alpha$ to be 3 $cm^{-1}$. Such a structure provides an improved electrical structure over known structures. Thus, the method of the present invention provides an improved method of fabricating a micro-coaxial wiring structure with desired advantageous electrical characteristics, the electrical characteristics being based upon the electrical modeling.

Figure 6:
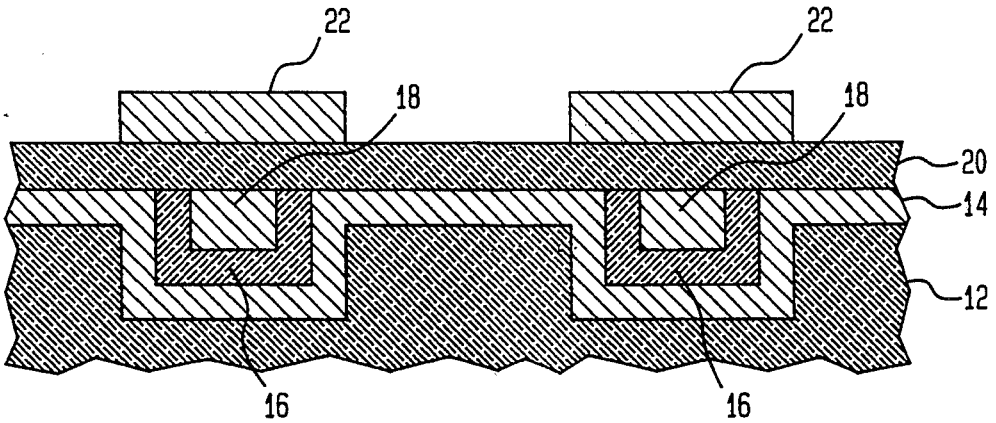
FIG. 6 shows a cross-sectional view of an alternate embodiment of the micro-coaxial wiring structure of the present invention.

In an alternate embodiment according to the present invention, more than one conductive signal line may be formed. See FIG. 6. Formation of the micro-coaxial wiring structure 50 of the alternate embodiment is similar to that of the preferred embodiment. The difference in the alternate embodiment is that at least two first trenches of first dimensions are formed in the first insulator layer. Subsequent formation of at least two conductive signal lines 18 having a predetermined aspect ratio of width to height for providing a desired value of resistance per unit length is similar to the formation of the conductive signal line 18 of the preferred embodiment.

Figure 7:
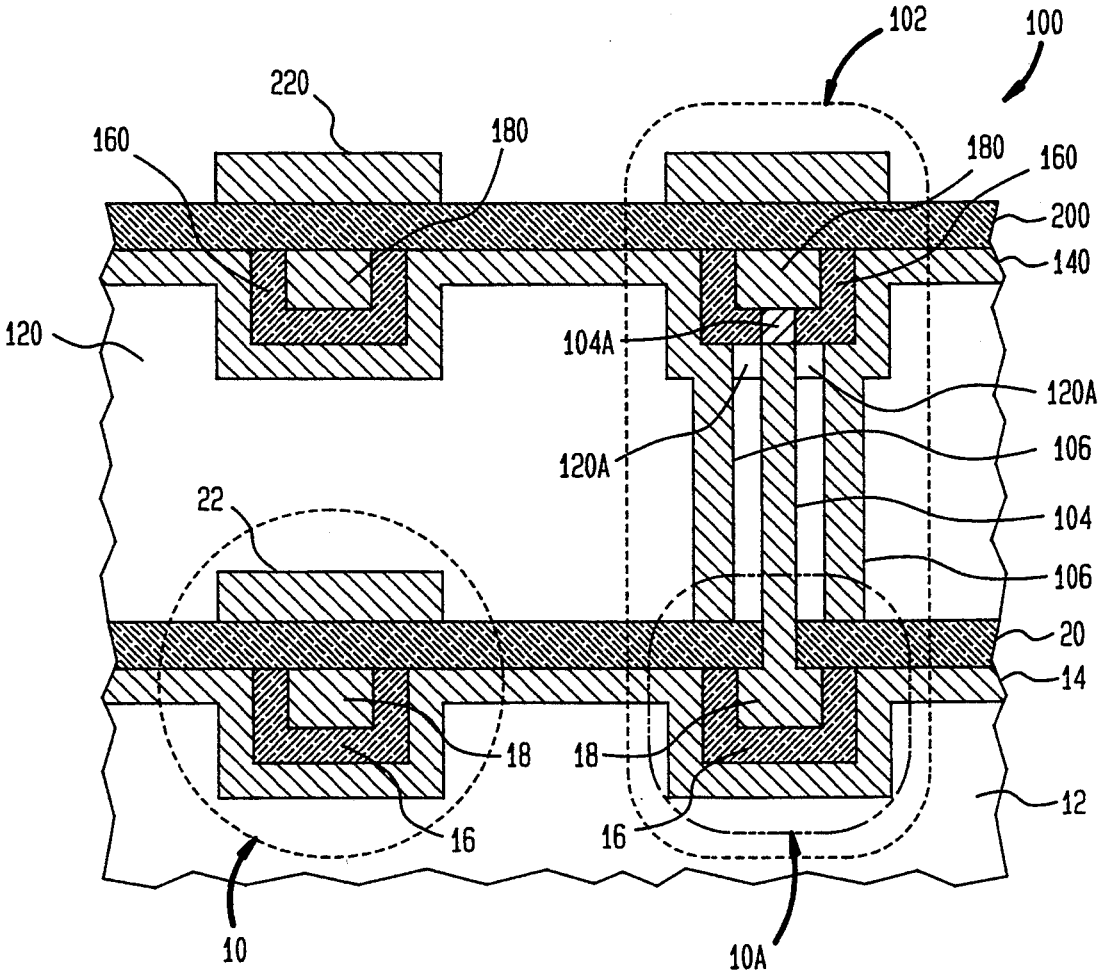
FIG. 7 shows a cross-sectional view of a second alternate embodiment of the micro-coaxial wiring structure of the present invention.

In yet another alternate embodiment of the present invention, the micro-coaxial wiring structure comprises multiple levels. Referring now to FIG. 7, the micro-coaxial wiring structure 100 comprises first level micro-coaxial wiring structures 10, 10A, and micro-coaxial stud 102. Fabrication of the wiring structure 100 continues after fabrication of first level formation of micro-coaxial wiring structures 10 and 10A. Micro-coaxial wiring structure 10A differs from 10 in that the conductive shielding line 22 is not formed above conductive signal line 18 in an area for placement of a vertical stud. Alternatively, subsequent to the formation conductive shielding line 22, a portion thereof may be patterned and etched in the desired location of the vertical stud. A thick dielectric material 120 is then deposited upon the structure 10 and 10A. A deep aperture is etched through the dielectric material 120, along with a surrounding concentric aperture for the ground plane (yet to be formed). The vertical stud 104 and the surrounding concentric ground plane 106 are formed by filling the deep aperture and the surrounding concentric aperture with a metal. Vertical stud 104 is in electrical contact with corresponding first level conductive signal line 18.

Formation of the second level micro-coaxial wiring structure proceeds similarly as with the formation of the first level micro-coaxial wiring structure. At the second level of wiring, a trench is formed in a desired location of the vertical stud such that the vertical stud 104 contacts the conductive signal line 180 and the vertical ground sheath 106 contacts the ground plane 140. More particularly, second level trenches of desired dimensions are formed in dielectric material 120. A conformal layer or ground plane 140 is formed upon patterned dielectric layer 120. In the area of vertical stud 104 and ground sheath 106, a portion of ground plane 140 is patterned, etched, and filled with dielectric material 120A, thereby maintaining isolation between stud 104 and sheath 106, i.e., by formation of an isolation ring in ground plane 140. An inter-wiring dielectric layer 160 is then formed, similarly as in the preferred embodiment; however, in the area of vertical stud 104, a portion of dielectric layer 160 is patterned, etched, and filled with conductive material 104A, forming a second level conductive stud. Conductive material 104A is in electrical connection with stud 104 and a corresponding second level conductive signal line 180. Formation of second level conductive signal lines 180, dielectric layer 200, and conductive shielding lines 220 proceed similarly as in the preferred embodiment.

There is thus provided a micro-coaxial wiring structure and a method of making the same which provides signal lines having a characteristic impedance as close to 50 ohm as possible and which improves high speed pulse propagation while substantially eliminating cross-talk between adjacent signal lines. Also provided is a microcoaxial wiring structure and a method of making the same wherein a desired value of resistance per unit length of a conductive signal line is obtained.

While the invention has been particularly shown and described with reference to the preferred and alternate embodiments thereof, it will be understood by those skilled in the art that various changes in form and detail may be made therein without departing from the spirit and scope of the invention.

What is claimed is:

1. A method of fabricating a micro-coaxial wiring structure, said method comprising the steps of:

a) forming a first insulator layer;

b) patterning a first trench of first dimensions in the first insulator layer;

c) forming a first conductive layer on the first insulator layer, the first conductive layer having a shape conforming to the first insulator layer and lining the first trench to form a second trench of second dimensions within the first trench;

d) forming a second insulator layer on the first conductive layer, the second insulator layer having a shape conforming to the first conductive layer and lining the second trench to form a third trench of third dimensions within the second trench;

e) planarizing the second insulator layer down to the first conductive layer, thereby planarizing the third trench, the planarized third trench being of predetermined dimensions;

f) forming a conductive signal line within the planarized third trench, the conductive signal line having a predetermined aspect ratio of width to height corresponding to the dimensions of the planarized third trench for providing a desired value of resistance per unit length and further being electrically shielded by the first conformal conductive layer;

g) forming a third insulation layer upon the first conductive layer, the second insulation layer, and the conductive signal line; and h) forming a conductive shielding line upon the third insulation layer, the conductive shielding line being in alignment with the first trench and further shielding the conductive signal line.

2. The method of claim 1, wherein the aspect ratio of the conductive signal line is in the range of $\frac{1}{4}$ to 1.

3. The method of claim 1, wherein the dimensions of the second trench comprise a width to height ratio of 3/2 and the aspect ratio of the conductive signal line is 1.

4. A method of fabricating a micro-coaxial wiring structure having at least two adjacent micro-coaxial conductive signal lines whereby cross-talk between the conductive signal lines is substantially eliminated and a desired value of resistance per unit length for each conductive signal line is obtained, said method comprising the steps of:

a) forming a first insulator layer;

b) patterning at least two first trenches of first dimensions in the first insulator layer;

c) forming a first conductive layer on the first insulator layer, the first conductive layer having a shape conforming to the first insulator layer and lining the at least two first trenches to form at least two second trenches of second dimensions within the corresponding first trenches;

d) forming a second insulator layer on the first conductive layer, the second insulator layer having a shape conforming to the first conductive layer and lining the at least two second trenches to form at least two third trenches of third dimensions within the corresponding second trenches;

e) planarizing the second insulator layer down to the first conductive layer, thereby planarizing the at least two third trenches, the planarized third trenches being of predetermined dimensions;

f) forming the at least two conductive signal lines within the planarized third trenches, the conductive signal lines having a predetermined aspect ratio of width to height corresponding to the dimensions of the planarized third trenches for providing the desired value of resistance per unit length and further being electrically shielded by the first conformal conductive layer;

g) forming a third insulation layer upon the first conductive layer, the second insulation layer, and the conductive signal lines; and h) forming at least two conductive shielding lines upon the third insulation layer, the conductive shielding lines being in corresponding alignment with the at least two first trenches and further shielding the at least two conductive signal lines.

5. The method of claim 4, wherein the aspect ratio of the at least two conductive signal lines is in the range of $\frac{1}{4}$ to 1.

6. The method of claim 4, wherein the dimensions of the at least two second trenches comprise a width to height ratio of 3/2 and the aspect ratio of the at least two conductive signal lines is 1.

7. The method of claim 1, further comprising the steps of:

i) removing a desired portion of said conductive shielding line, said conductive shielding line corresponding to a first level conductive shielding line;

j) depositing a fourth dielectric layer upon the third insulation layer and the first level conductive shielding line;

k) etching at least one stud aperture and corresponding concentric sheath aperture through the fourth dielectric layer in a location corresponding to the desired removed portion of the first level conductive shielding line, the at least one stud aperture making contact with the conductive signal line corresponding to a first level conductive signal line;

l) filling the at least one stud and sheath apertures with conductive material; and m) repeating steps b) through h) to form a second level micro-coaxial signal conductor and still further comprising the steps of n) subsequent to forming a second level first conductive layer, forming at least one second level insulating ring in the second level first conductive layer to insulate the at least one stud from the corresponding conductive sheath, and o) subsequent to forming a second level inter-wiring dielectric, forming at least one second level conductive stud in the second level inter-wiring dielectric to provide electrical contact between the at least one stud and the corresponding second level conductive signal line.

* * * * *